US005674014A

United States Patent [19]

Jordan

[11] Patent Number: 5,674,014

[45] Date of Patent: Oct. 7, 1997

[54] PRINTHEAD DRIVER CIRCUIT FOR LINE PRINTERS

[75] Inventor: James Douglas Jordan, Round Rock, Tex.

[73] Assignee: International Business Machines Corporation, Armonk, N.Y.

[21] Appl. No.: 658,836

[22] Filed: May 31, 1996

[51] Int. Cl.[6] ..... B41J 2/30

[52] U.S. Cl. ..... 400/124.02; 400/124.05; 400/124.18

[58] Field of Search ..... 400/124.02, 124.05, 400/124.14, 124.17, 124.18

[56] References Cited

U.S. PATENT DOCUMENTS

| | | | |
|---|---|---|---|
| 3,919,935 | 11/1975 | Langnickel | 101/93.04 |
| 4,637,742 | 1/1987 | Sakai | 400/121 |
| 4,850,724 | 7/1989 | Fattori | 400/157.2 |
| 5,032,031 | 7/1991 | Griiner et al. | 400/157.2 |
| 5,099,383 | 3/1992 | Fukano et al. | 361/153 |

FOREIGN PATENT DOCUMENTS

| | | |
|---|---|---|
| 2011338 | 1/1990 | Japan . |
| 2070450 | 3/1990 | Japan . |

*Primary Examiner*—John S. Hilten

*Attorney, Agent, or Firm*—A. P. Tennent; Andrew J. Dillon

[57] ABSTRACT

A printhead drive circuit to be utilized in impact printers is disclosed. In accordance with a preferred embodiment of the present invention, the printhead driver circuit includes a first switch, a set of second switches, and a decoupling circuit. The first switch is coupled between a first terminal of a DC power supply and a first terminal of a set of solenoid coils. The set of second switches is utilized to selectively energize each of the solenoid coils within the set. Each of the second switches is also respectively coupled between a second terminal of each of the solenoid coils and a second terminal of the DC power supply. The decoupling circuit is for selectively decoupling a first group of solenoid coils within the set that are not energized from a second group of solenoid coils within the set that are energized. The decoupling circuit is connected between the first terminal of the DC power supply and the second terminal of each solenoid coil via a diode at each of the second terminals of each solenoid coil.

12 Claims, 7 Drawing Sheets

PRINTHEAD DRIVER CIRCUIT FOR LINE PRINTERS

BACKGROUND OF THE INVENTION

1. Technical Field

The present invention relates to an apparatus for computer output printers in general and, in particular, to a driver circuit for an impact printer. Still more particularly, the present invention relates to a printhead driver circuit for an impact line printer.

2. Description of the Prior Art

Electronic printers for computer output represent a very important part of the computer industry. These printers range from small and inexpensive printers for personal computers to very large and fast page printers for mainframe computers. The technologies employed for this wide range of printers can generally be classified under two types, namely, impact printers and non-impact printers.

Impact printers have a well recognized appeal within the banking industry primarily because of their ability to print multipart forms while maintaining low cost and high reliability. Further, important features a customer would look for in an impact printer are high speed, high impact force, and low cost.

A printhead driver circuit for an impact printer can be designed to minimize cost at the expense of power supply size, part stress, and high thermal dissipation. Alternately, a printhead driver circuit can be designed to maximize efficiency by recovering energy from print wires, such that power supply size, part stress, and thermal dissipation can all be reduced. Though the latter approach is generally penalized with a higher component cost and a higher component count in the printhead driver circuit itself.

In general, a printhead driver circuit which has a common return path is desirable for both of the above-identified design approaches because such an approach reduces the number of wires in a cable, the size of connectors, and the number of transistors needed for current control in multiple print wires. However, there are also limitations as to the repetition rate versus pulse width that this type of driver circuit can offer to the printhead. Testing has shown that if a second print wire is energized too soon, the energizing current from the second print wire may couple into the chop path of a first print wire which has just been de-energized. This current cross-coupling among print wires and the latent recovery time for an individual print wire can prevent the protruding print wire from returning to its home position and may thus result in a ribbon-snagging problem.

Consequently, it would be desirable to provide a printhead driver circuit that can resolve the print wire current cross-coupling problem in order to enhance the performance of a printhead utilized within an impact line printer.

SUMMARY OF THE INVENTION

In view of the foregoing, it is therefore an object of the present invention to provide an improved apparatus for computer output printers.

It is another object of the present invention to provide an improved driver circuit for an impact printer.

It is yet another object of the present invention to provide an improved printhead driver circuit for resolving the print-wire-coupling problem such that the performance of a printhead can be enhanced.

In accordance with a preferred embodiment of the present invention, a printhead driver circuit for impact printers is provided which includes a first switch, a set of second switches, and a decoupling circuit. The first switch is coupled between a first terminal of a DC power supply and a first terminal of a set of solenoid coils. The set of second switches is utilized to selectively energize each of the solenoid coils within the set. Each of the second switches is also respectively coupled between a second terminal of each of the solenoid coils and a second terminal of the DC power supply. The decoupling circuit is utilized to selectively decouple a first group of solenoid coils within the set that are not energized from a second group of solenoid coils within the set that are energized. The decoupling circuit is connected between the first terminal of the DC power supply and the second terminal of each solenoid coil via a diode at each of the second terminals of each solenoid coil.

All objects, features, and advantages of the present invention will become apparent in the following detailed written description.

BRIEF DESCRIPTION OF THE DRAWINGS

The invention itself, as well as a preferred mode of use, further objects, and advantages thereof, will best be understood by reference to the following detailed description of an illustrative embodiment when read in conjunction with the accompanying drawings, wherein.

DETAILED DESCRIPTION OF A PREFERRED EMBODIMENT

The present invention may be applicable to a variety of impact-type electronic computer printers having a chopper driver circuit for a serial printhead. For the purpose of illustration, a preferred embodiment of the present invention, as described below, is implemented on an impact-type electronic computer printer, such as the 4772 series manufactured by International Business Machines Corporation.

Figure 1:
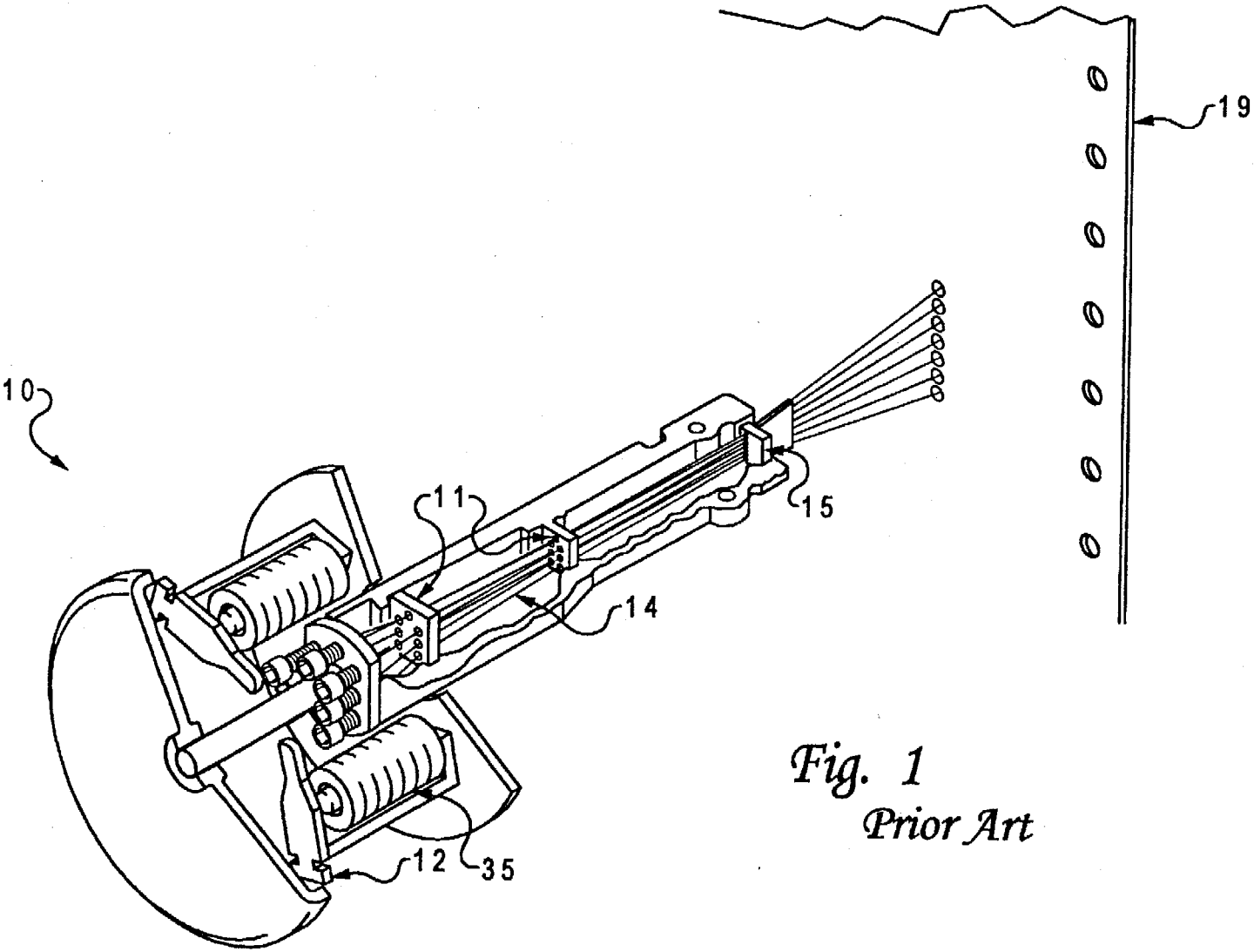
Fig. 1 Prior Art
FIG. 1 is a pictorial diagram of a wire serial printhead.

Referring now to the figures and in particular to FIG. 1, there is depicted a pictorial diagram of a wire serial printhead 10. Printhead 10 includes an array of print wires 14 which are typically made of tungsten. Each print wire 14 is individually connected to an armature 12 and a solenoid coil 35 such that each print wire 14 may be driven into ribbon/paper set 19. Also shown are bulkheads 11 and jewel 15 utilized as wire guides. Print wires 14 may form a single-row configuration at the plane of impact, as shown, or may have two in-line rows, or may have two staggered rows. In general, the number of print wires 14 per printhead 10 ranges from nine for a low-cost printer to twenty-four for a high-end printer.

Figure 2:
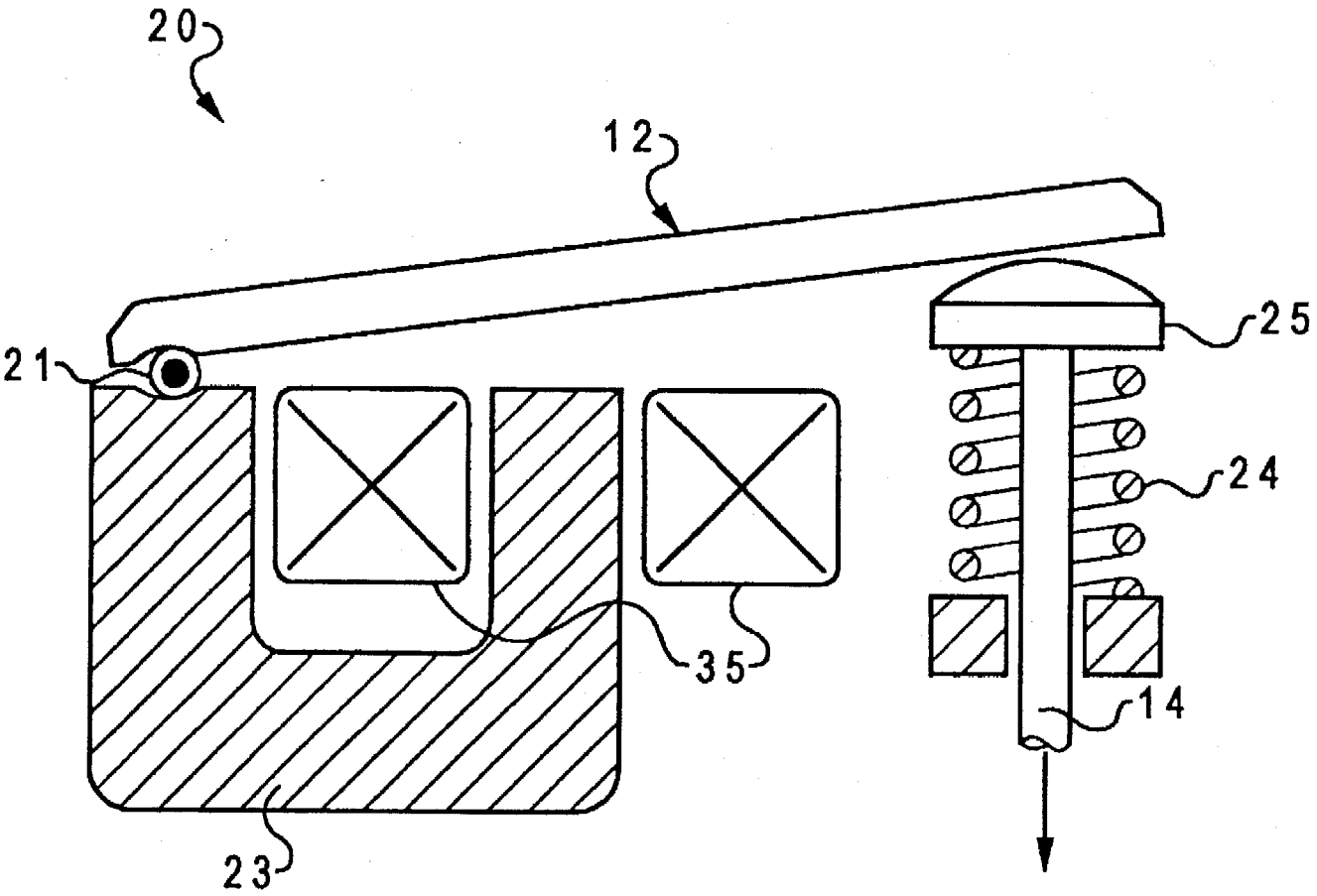
Fig. 2 Prior Art
FIG. 2 is a cross-sectional diagram of a pivot-type actuator employed by the serial printhead depicted in FIG. 1.

With reference now to FIG. 2, there is illustrated a cross-sectional diagram of a pivot-type actuator employed by printhead 10 of FIG. 1. As shown, actuator 20 is comprised of armature 12, solenoid coil 35, pole piece 23, and spring 24. During operation, a magnetic force from pole piece 23 generated by an electric current flowing through solenoid coil 35 will force armature 12 to drive print wire 14 at wire head 25. After the magnetic force from pole piece 23 has subsided, armature 12 is pushed back to its resting (or home) position by the recoil force from spring 24. Typically, armature 12, which is pivoting on pivot point 21, is quite robust and can provide impact through many layers of a multipart form.

Figure 3:
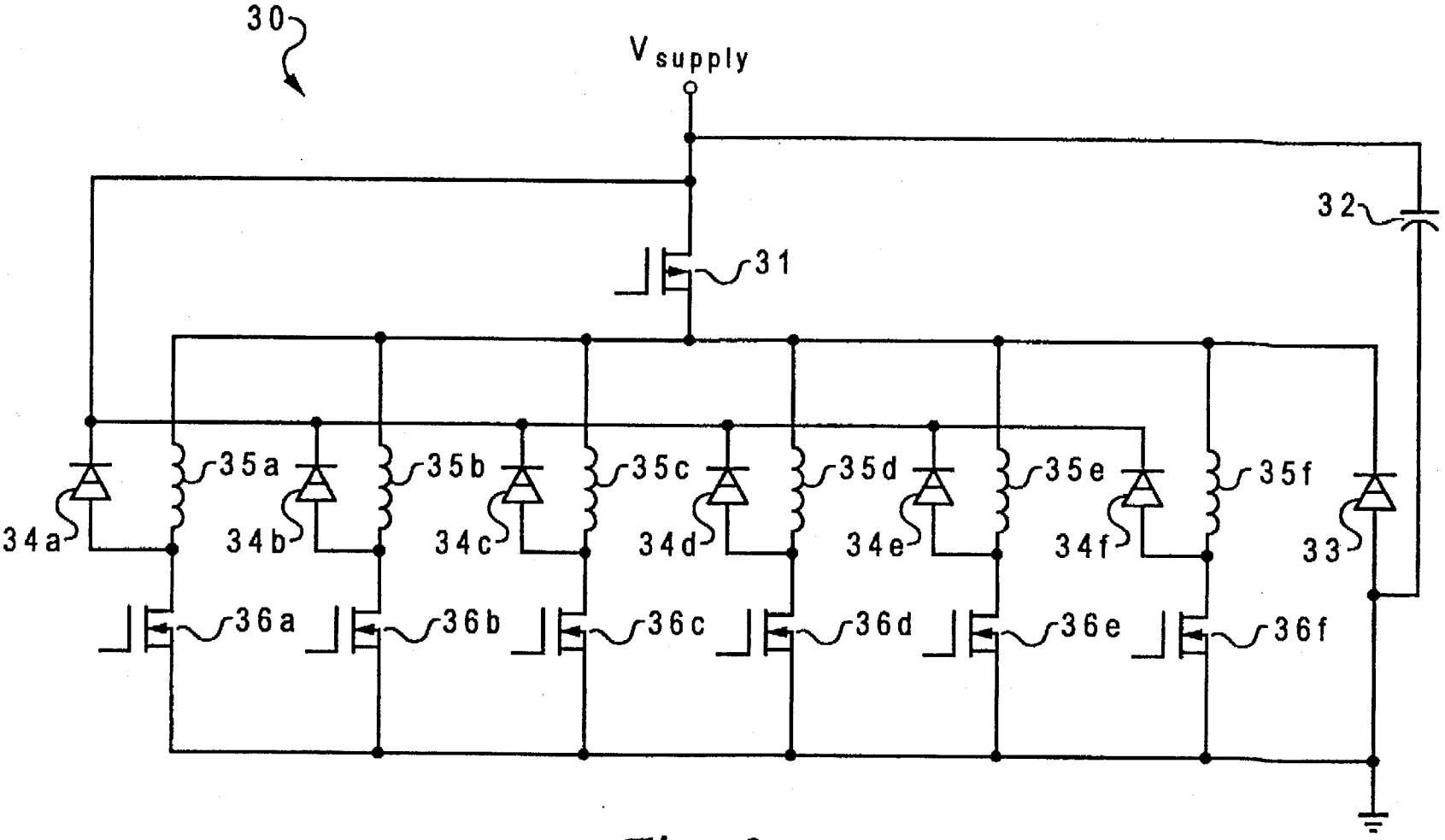
Fig. 3 Prior Art
FIG. 3 is a schematic diagram of a driver circuit for the printhead of FIG. 1, according to prior art.

Referring now to FIG. 3, there is depicted a schematic diagram of a driver circuit 30 for printhead 10 of FIG. 1, according to prior art. A set of driving components, namely, a diode, a solenoid coil, and an n-channel FET, is responsible for driving one print wire within printhead 10. Hence, as shown in FIG. 3, driver circuit 30, having diodes 34*a*–35*f*, solenoid coils 35*a*–35*f*, and n-channel FETs 36*a*–36*f*, can individually and simultaneously drive six different print wires. All these driving components are connected to a power supply, $V_{supply}$, via a common p-channel FET 31. Typically, $V_{supply}$ is approximately +39 V d.c. In addition, driver circuit 30 may include an energy conservation loop which comprises a capacitor 32 and a catch diode 33. Capacitor 32 is connected between $V_{supply}$ and Ground while the cathode of catch diode 33 is connected to the drain of p-channel FET 31. The capacitance of capacitor 32 is about 15,000 μF.

Figure 4:
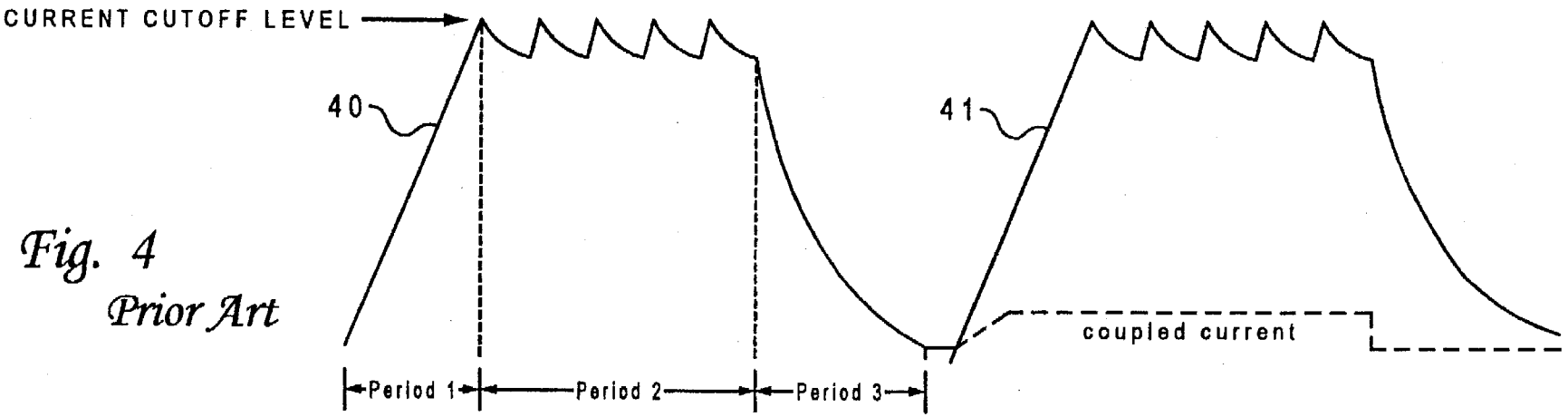
Fig. 4 Prior Art
FIG. 4 is a waveform diagram illustrating the current level with a solenoid coil of the driver circuit of FIG. 3.

With reference now to FIG. 4, there is illustrated the current level within a solenoid coil of drive circuit 30 during its operation. Initially, FET 31 and, for example, FET 36*a*, are turned on, and thus current flows through solenoid coil 35*a* to drive a corresponding print wire. This is represented by Period 1 of waveform 40, as coil current ramps up according to the equation $V=L\Delta i/\Delta t$. When the current within solenoid coil 35*a* reaches a cutoff level (approximately 2.0–2.2A), FET 36*a* will be turned off. At this point, current in solenoid coil 35*a* then circulates within a closed path of FET 31 and diode 34*a*, while decaying slowly. As soon as FET 36*a* is turned on again (usually by a timer circuit), the current in solenoid coil 35*a* ramps back up again, flowing from $V_{supply}$ through FET 31, solenoid coil 35*a* and FET 36*a*, until the cutoff level is reached. This chop process is repeated until a suitable pulse width for driving the corresponding print wire is reached, at which both FET 31 and FET 36*a* will be turned off. The repetitious on and off cycling rate for FET 36*a* is about 50 KHz. This is represented by Period 2 of waveform 40. When both FET 31 and FET 36*a* are off, the current within solenoid coil 35*a* has to flow through diode 34*a* and catch diode 33 in order to dump the energy stored in solenoid coil 35*a* into capacitor 32, until the current level within solenoid coil 35*a* reaches zero. This is represented by Period 3 of waveform 40.

The problem associated with printer driver circuit 30 is that cross-coupling may occur among print wires. For example, if FET 31 is turned on anytime during Period 3 (or shortly after Period 3) of waveform 40 for the purpose of driving any other solenoid coil other than solenoid coil 35*a*, a current cross-coupling may occur within the recirculating path of solenoid coil 35*a*. This cross-coupling phenomenon is also illustrated in FIG. 4. When FET 31 is turned on for driving, for example, solenoid coil 35*b* before the energy in solenoid coil 35*a* has been completely dissipated, the current ramp-up in waveform 41 will not only sustain waveform 40 from further decay but may also raise waveform 40 to a level that solenoid coil 35*a* can still be holding its corresponding print wire. The protruding of the print wire may catch the moving printer ribbon to cause an undesirable result of ribbon-snagging. Although this problem can be resolved by waiting until the corresponding print wire for solenoid coil 35*a* has returned back to its home position before FET 31 is turned on for energizing other solenoid coils, the pulse width or the repetition rate would be severely limited.

Figure 5:
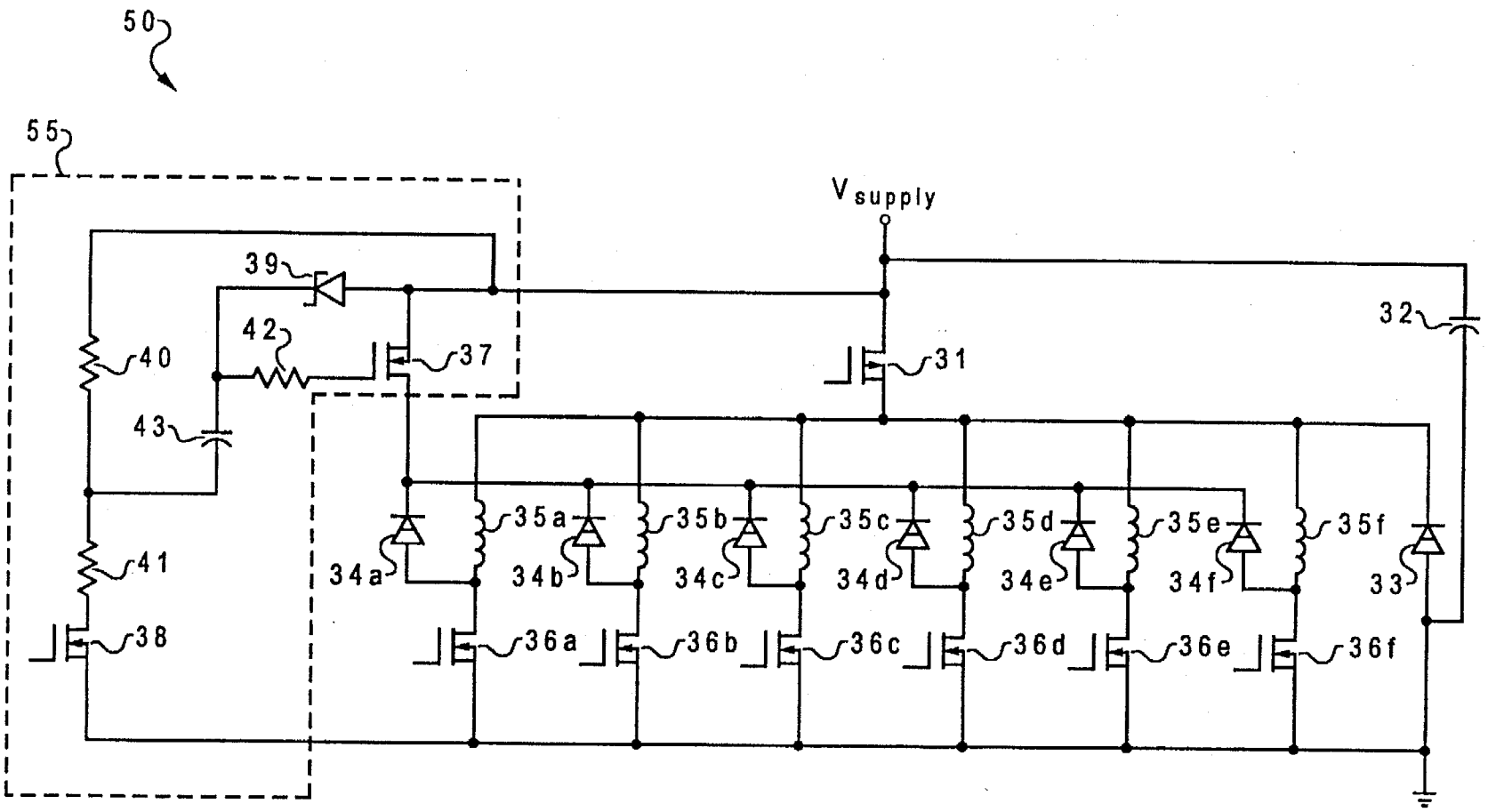
FIG. 5 is a schematic diagram of a driver circuit for the printhead of FIG. 1, according to a preferred embodiment of the invention.

With reference now to FIG. 5, there is depicted a schematic diagram of a driver circuit 50 for printhead 10 of FIG. 1, according to a preferred embodiment of the invention. As shown, the connection for p-channel FET 31, capacitor 32, diode 33, diodes 34*a*–34*f*, solenoid coils 35*a*–35*f*, and n-channel FETs 36*a*–36*f* are identical to those depicted in FIG. 3. The novelty in driver circuit 50 of FIG. 5 as compared to driver circuit 30 of FIG. 3 lies upon the addition of a decoupling circuit 55.

Decoupling circuit 55 comprises a Zener diode 39, a capacitor 43, two n-channel FETs 37, 38, and three resistors 40, 41, 42. FET 37 is connected between the cathode of diodes 34*a*–34*f* and $V_{supply}$, while FET 38 is connected in series with resistor 40 (~1KΩ) and resistor 41 (~2.2KΩ) between $V_{supply}$ and Ground. Capacitor 43 (~0.02μF) is connected to the gate of FET 37 via resistor 42 (~100Ω) and the node between resistors 40 and 41. The source of FET 37 is coupled to $V_{supply}$ and the anode of Zener diode 39. One purpose of FET 37 is to break the recirculating (or energy conservation) loop for any solenoid coils 35*a*–35*f* that are not utilized for driving a respective print wire. This ensures that the cross-coupling phenomenon, as mentioned previously, will not occur when the energizing time among adjacent solenoid coils happens too soon after each other. Another purpose of FET 37 is to initiate an avalanche across FETs 36*a*–36*f*. This avalanche can drastically reduce the reset time.

The gate of FET 37 must be driven to approximately 10 V above $V_{supply}$ in order for it to be turned on. This is accomplished by first charging capacitor 43 to +11.5 V from $V_{supply}$ through Zener diode 39 and a voltage divider formed by resistors 40 and 41. When FET 38 is turned off, the drain of FET 38 and the node between resistors 40 and 41 (the bottom node of capacitor 43) become +39 V. Thus, the top node of capacitor 43 should be approximately +11.5 V above the bottom node of capacitor 43, while still holding the majority of its charge. Connecting FET 37 backwards as how an n-channel FET is normally utilized allows a precision control of the gate with respect to a constant voltage (+39 V) by way of a charge-pump circuit and an internal diode of FET 37 to be oriented properly so that the flyback voltage at the bottom of solenoid coils 35*a*–35*f* does not conduct through FET 37 when any one of solenoid coils 35*a*–35*f* is dumping energy. (note: The charge-pump circuit comprises resistors 40, 41, capacitor 43, Zener diode 39, and FET 38.) This independent control is utilized for both opening the chop path during the initial coil-energizing period, preventing coupling during wire returns, and for controlling the conservation and avalanching of returning wire energy.

FET 37 will be turned off before FET 31 is turned on again for the purpose of providing a faster reset time through avalanching and allowing current to ramp up in another print wire tied to the source of FET 31. Thus, it is not necessary to wait for the print wire corresponding to any one of solenoid coils 35*a*–35*f* to return to its home position before energizing another solenoid coil. If FET 31 is turned on before FET 37 is turned off, the current in solenoid coil 35*a* will stall at whatever level it is currently at the instant when FET 31 is turned on. This is caused by the 39 V reduction in voltage at the solenoid coil the moment when FET 31 is turned on. Thus, the precision control of the operating time of FET 37 allows the reduction of reset time through an avalanching of a small amount of energy in each solenoid coil. The maximum theoretical pulse width/speed is then given by 1/(freq FET 31)$-\Delta t_{reset}$=Maximum pulse width. For example, if the switching frequency of FET 31 is 3,510 Hz and the time to reset the wire current to zero is 34 μs (depending on the avalanching voltages of FETs 36*a*–36*f*, 37 and the current level at which the avalanche started), the maximum pulse width will be 285 μs–34 μs=251 μs.

Figure 6:
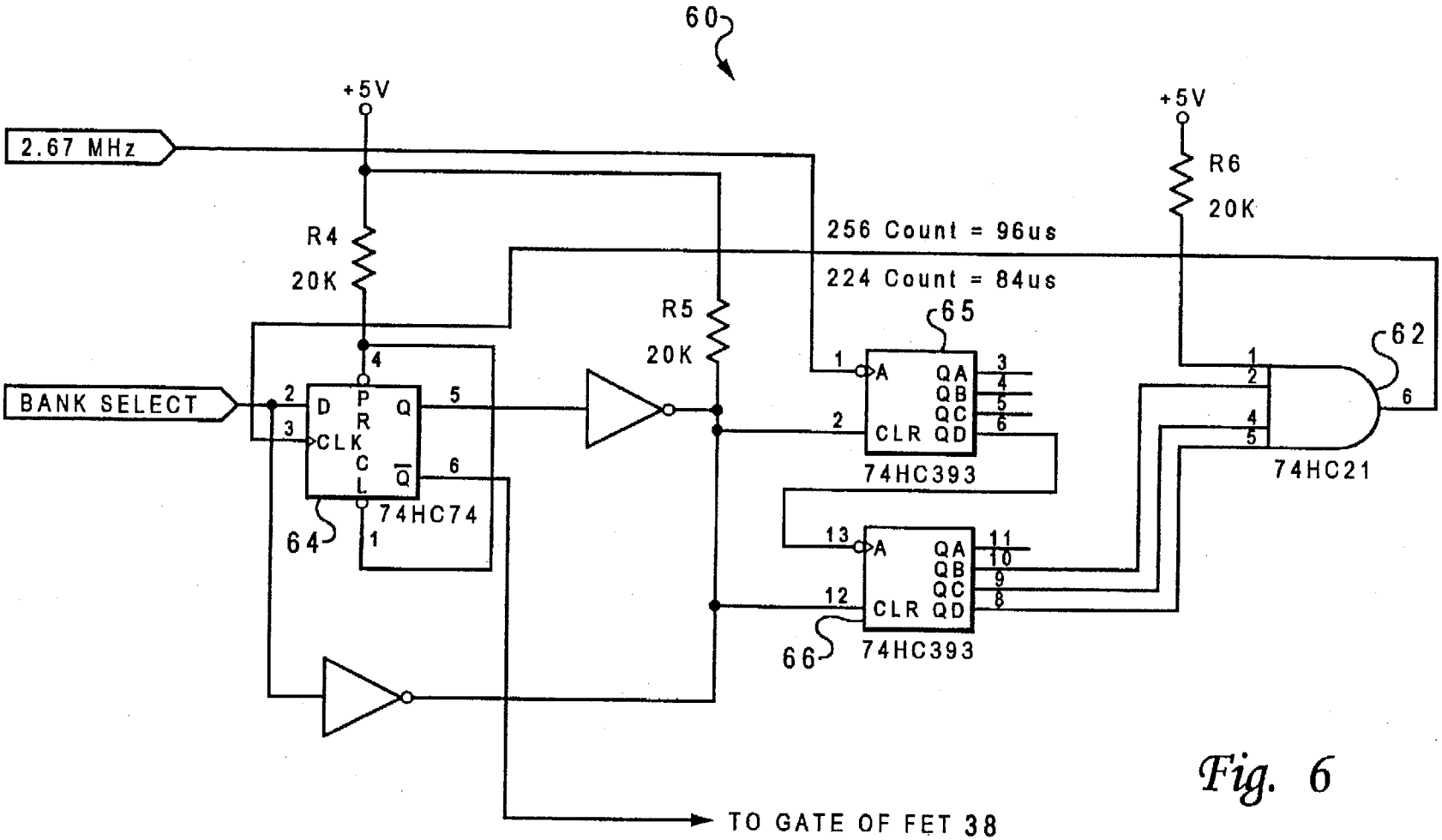
FIG. 6 is a schematic diagram of a control circuit for controlling the decoupling circuit of FIG. 5.

With reference now to FIG. 6, there is depicted a control circuit 60 for controlling the decoupling circuit of FIG. 5, in accordance with a preferred embodiment of the invention. Timing for control circuit 60 may be developed from a 16 MHz oscillator. The 16 MHz clock frequency can be divided by 6 to become a 2.67 MHz clock frequency. This 2.67 MHz clock frequency is then input into a counter 65 for each bank of print wires, with preferably six print wires per bank, as shown in FIG. 5. Counter 65 is cascaded with another four-bit counter 66 to provide a divide-by-256 count. A four-input AND gate 62 is utilized to decode the precise timing of the delay which is utilized to clock the output of a D flip-flop 64. Counter 65 is then allowed to wrap until the D input of flip-flop 64 is low, where, once it reaches the decoded count, it will clock through the low level on the D input to the output. This decoded count controls the starting time of the avalanching for FET 36*a*–36*f*. The timed pulse for FET 37 in FIG. 5 comes from flip-flop 64. The $\overline{Q}$ output of flip-flop 64 is utilized to drive the gate of FET 38 of decoupling circuit 55 in FIG. 5.

Figure 7:
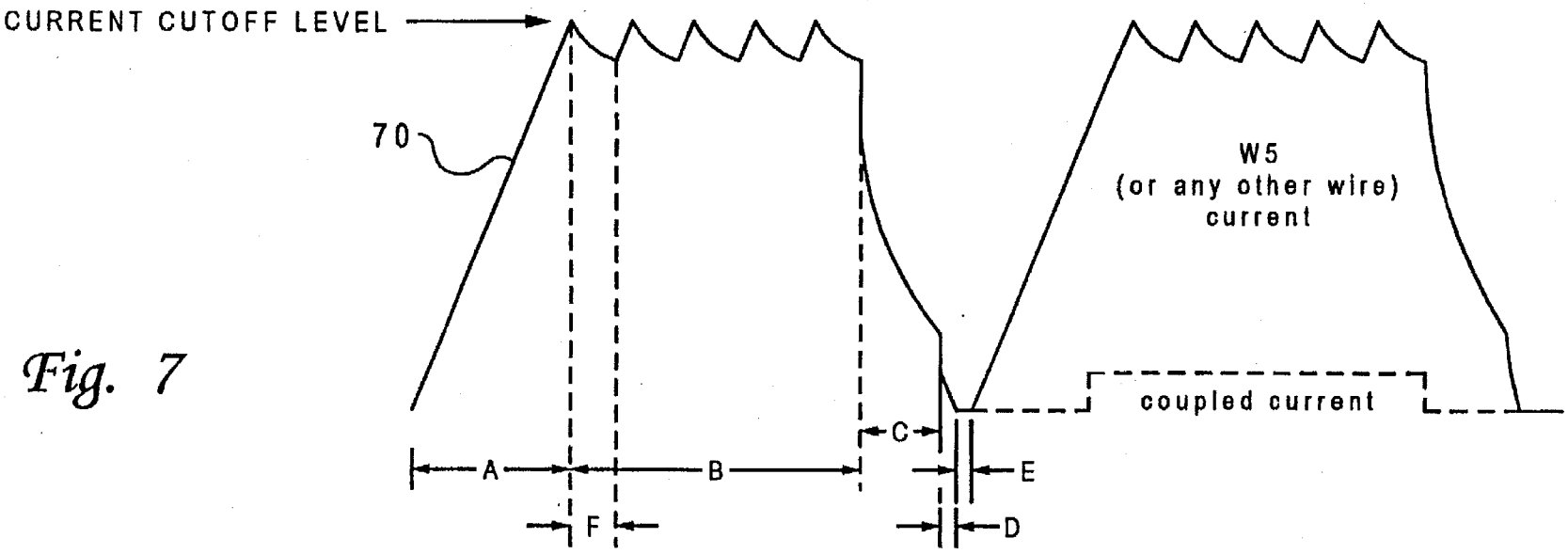
FIG. 7 is a waveform diagram illustrating the current level with a solenoid coil of the driver circuit of FIG. 5.

Referring now to FIG. 7, there is illustrated the current level within a solenoid coil of drive circuit 50 during its operation, according to a preferred embodiment of the invention. As shown, Period A, Period B, and Period C of waveform 70 are identical to Period 1, Period 2 and the initial portion of Period 3 of waveform 40 in FIG. 4, respectively. Period D is the avalanche period when FET 37 within driver circuit 50 is off. Power is being avalanched across appropriate chop switches, i.e., one or more of FETs 36*a*–36*f*. Period E is the safety period during which current in any solenoid coils 35*a*–35*f* is close to zero ampere. Finally, Period F is the recirculating period when FET 31 and FET 37 are turned on while FETs 36*a*–36*f* are all off.

The present invention uniquely combines several features to provide a minimal component and space solution to increase print wire performance. First of all, a majority of energy from any solenoid coil through a closed return path to power supply output capacitor 32 is recovered. Second, the precision timing of the switched recirculation path provides three distinctive rates of decay for the coil currents, namely, energy recovery (Period C), avalanching (Period D) and recirculating (Period F), as shown in FIG. 7. Third, a faster reset time is achieved by uniquely avalanching a fraction of one solenoid coil's energy across its associated chop switch, thereby limiting the remaining coil energy (when chop path switch, FET 37 is turned off) of one solenoid coil to one chop switch. Finally, an open chop path is provided for returning physical wires such that any adjacent coil may be energized at any time during period A of FIG. 7 without the problem of creating coupled current.

The independent and precision control (with respect to the switch timings for solenoid coil control) permits the reset of a coil's current in approximately half the time of a standard two-stage energy conservation chopper driver circuit known in the art, which does not include a separate absorption circuit. As mentioned previously, such reset timing reduction is achieved by delaying the absorption period until the current in a solenoid coil is at a fraction of its peak current, where the energy can be handled as avalanche energy in the chop switches. Thus, the independent and precision control of the chop path switch provides a near-zero current flow in a resetting solenoid coil the instant any other solenoid coil is being energized.

In addition to the chopper-type driver circuit, the present invention will also work with a voltage-mode-type printhead. In the latter case, FET 37 is first turned off during the current ramp-up period while FET 31 and one or more of FETs 36*a*–36*f* are turned on. Then, FET 37 would be turned on prior to or at the beginning of the recirculating period (while FETs 36*a*–36*f* are off and FET 31 is on). Subsequently, FET 31 is turned off to quickly dump most of the coil energy to the power supply. Finally, FET 37 is turned off in order to avalanche the remaining coil energy.

As has been described, the present invention provides an improved circuit for enhancing the performance of a printhead utilized within an impact line printer. This invention eliminates the problem of ribbon-snagging, and allows the increase in print speed as well as pulse width while recovering the majority of energy back in the print wire. Because the print speed can be increased in the high-speed mode, a substantially cheaper printhead (which requires a longer pulse width to achieve similar impact force) may be utilized with a minimal drop in print speed performance, assuming the drive times of the FETs are adjusted to match the new printhead. Finally, the present invention keeps the stress levels on components to much lower levels than a conventional avalanche technique.

While the invention has been particularly shown and described with reference to a preferred embodiment, it will be understood by those skilled in the art that various changes in form and detail may be made therein without departing from the spirit and scope of the invention.

What is claimed is:

1. A printhead driver circuit for impact printers, said printhead driver circuit comprising:

a DC power supply having a first terminal and a second terminal;

a plurality of solenoid coils, each of said solenoid coils having a first terminal and a second terminal;

a first switching means coupled between said first terminal of said DC power supply and said first terminal of each of said plurality of solenoid coils;

a plurality of second switching means for selectively energizing each of said plurality of solenoid coils, each of said plurality of second switching means respectively coupled between said second terminal of each of said plurality of solenoid coils and said second terminal of said DC power supply; and a decoupling circuit for opening a chop path of said plurality of solenoid coils and for controlling the avalanche of any return energy from said plurality of solenoid coils, said decoupling circuit being connected between said first terminal of said DC power supply and said second terminal of each of said plurality of solenoid coils via a diode at each of said second terminal of each of said plurality of solenoid coils such that current cross-coupling between said first group of said plurality of solenoid coils and said second group of said plurality of solenoid coils is avoided.

2. The printhead driver circuit for impact printers according to claim 1, wherein said first switching means is a p-channel FET.

3. The printhead driver circuit for impact printers according to claim 1, wherein said plurality of second switching means are n-channel FETs.

4. The printhead driver circuit for impact printers according to claim 1, wherein said decoupling circuit includes a chop path switching means, wherein a gate of said chop path switching means is controlled by a charge-pump circuit having a timing independent of a flyback voltage and turn-on and turn-off times of said plurality of second switching means.

5. The printhead driver circuit for impact printers according to claim 4, wherein said chop path switching means is an n-channel FET having its source connected to said first terminal of said DC power supply.

6. The printhead driver circuit for impact printers according to claim 1, wherein said decoupling circuit includes a Zener diode, a capacitor, two n-channel FETs and three resistors.

7. The printhead driver circuit for impact printers according to claim 1, wherein said printhead driver circuit further includes an energy-absorbing means for absorbing energy discharged from said plurality of solenoid coils.

8. A printhead driver circuit for impact printers, said printhead driver circuit comprising:

a DC power supply having a first terminal and a second terminal;

a plurality of solenoid coils, each of said solenoid coils having a first terminal and a second terminal;

a first switching means coupled between said first terminal of said DC power supply and said first terminal of each of said plurality of solenoid coils;

a plurality of second switching means for selectively energizing each of said plurality of solenoid coils, each of said plurality of second switching means respectively coupled between said second terminal of each of said plurality of solenoid coils and said second terminal of said DC power supply; and a decoupling circuit for selectively decoupling a first group of said plurality of solenoid coils that are not energized from a second group of said plurality of solenoid coils that are energized, said decoupling circuit further comprising:

a chop path switching means connected between said first terminal of said DC power supply and said second terminal of each of said plurality of solenoid coils via a diode at each of said second terminal of each of said plurality of solenoid coils;

a Zener diode connected between said first terminal of said DC power supply and a gate of said chop path switching means via a first resistor;

a second resistor and a third resistor connected in series with a third switching means between said first terminal of said DC power supply and said second terminal of said DC power supply;

a capacitor connected between a node common to said second resistor and said third resistor and a node common to said Zener diode and said first resistor.

9. The printhead driver circuit for impact printers according to claim 8, wherein said first switching means is a p-channel FET.

10. The printhead driver circuit for impact printers according to claim 8, wherein said plurality of second switching means are n-channel FETs.

11. The printhead driver circuit for impact printers according to claim 8, wherein said chop path switching means is an n-channel FET having its source connected to said first terminal of said DC power supply.

12. The printhead driver circuit for impact printers according to claim 8, wherein said printhead driver circuit further includes an energy-absorbing means for absorbing energy discharged from said plurality of solenoid coils, said energy-absorbing means connecting between said first terminal of said DC power supply and said second terminal of said DC power supply.

* * * * *